United States Patent [19]

Callahan

[11] Patent Number: 4,817,292

[45] Date of Patent: Apr. 4, 1989

[54] PLEAT PLACEMENT CHART AND METHOD OF USING THE SAME

[76] Inventor: Earnest J. Callahan, 2207 Sims Way, Port Townsend, Wash. 98368

[21] Appl. No.: 29,061

[22] Filed: Mar. 23, 1987

[51] Int. Cl.[4] ..... G01B 3/10

[52] U.S. Cl. ..... 33/1 B; 33/563; 33/663

[58] Field of Search ..... 33/663, 563, 137, 494, 33/1 BR, 1 FG, 662; 223/28, 34, 35, 37, 38

[56] References Cited

U.S. PATENT DOCUMENTS

| | | | |
|---|---|---|---|
| 2,547,745 | 4/1951 | Cade et al. | 33/1 F |
| 2,777,617 | 1/1957 | Matt | 223/34 |
| 3,528,077 | 9/1970 | Seiden | 33/1 B |
| 3,645,000 | 2/1972 | Gass | 223/35 X |
| 3,645,003 | 2/1972 | Gass | 33/663 |
| 3,664,026 | 5/1972 | Lawson | 33/563 X |
| 3,696,515 | 10/1972 | Tuskos | 33/664 |

FOREIGN PATENT DOCUMENTS 3990 of 1885 United Kingdom ..... 33/474

*Primary Examiner*—Harry N. Haroian

[57] ABSTRACT

Disclosed herein is a chart and a preferred method of using it.

The chart consists of predetermined measurements printed, preferrably on a durable paper.

The chart is designed to give double fullness to drapes. This is accomplished by the pleated and the unpleated areas being the same width.

Vertical numbers 1–27 get progessively larger. They determine, by moving horizontally down the chart, the location of each pleated and unpleated area.

Horizontal lines start out progressively larger and they then continue to be drawn the same width down the remainder of the chart, approximately 13 feet 6 inches.

These lines determine how wide the pleated and unpleated areas are to be.

8 Claims, 2 Drawing Sheets

9
10
11
12
13
14
15
EAT
PLEAT
PLEAT
PLEAT
EAT
PLEAT
PLEAT
PLEAT
LEAT
PLEAT
PLEAT
PLEAT
LEAT
PLEAT
PLEAT
PL

PLEAT PLACEMENT CHART AND METHOD OF USING THE SAME

FIELD OF THE INVENTION

This invention pertains to drapery making. Particularly, a chart that shows the precise location of pleated and unpleated areas on any given width drapery.

BACKGROUND OF THE INVENTION

In this day and age of do-it-yourselfers, a need has arisen for the average person unskilled in the art of drapery fabrication, to be able to easily and economically construct their own draperies.

This chart will provide these means. It's a simple step by step method of pinch pleating draperies without the complicated process of measuring and figuring of where the pleats should be placed and how far apart they should be.

Past experience has shown that consumers have their biggest problem in drapery pleating when there is an existing drapery rod already in place. This means the draperies have to be pleated to the precise width to fit the drapery rod. By using this chart, this is now easily accomplished.

Pleating devices now available are large, expensive and are designed for commercial use. Only one skilled in the art with plenty of money to spend would have a use for this type of device. Reference is made to U.S. Pat. No. 3-464-600. These conditions virtually eliminate the average person from being able to purchase such a device.

The chart is small enough to be rolled up for easy shipping and storage. It can be used in any home on the average kitchen table or floor, virtually eliminates all the complex figuring involved in drapery making, and is inexpensive to manufacture, therefore, making it very economical for the consumer to purchase.

HOW TO USE THE CHART

It needs to be understood that you need the unpleated drapery panel twice the width you want it to finish. Example: You would need a panel 12' wide to make a finished double fullness drapery 6' wide.

Step 1. Lay the chart face up on the work table as shown in FIG. 1. Place the drapery fabric wrong side up on the chart.

Step 2. Measure in 3½" and mark the top edge with a straight pin. This will be the return. If a wider return is required, use that measurement instead of the standard 3½" return. On the opposite corner, measure in 3" and mark with a straight pin. This will be the overlap.

Step 3. With the drapery fabric wrong side up on the chart on line 1, line up the straight pin with the letter A. This is the beginning of a pleat. Move the fabric vertically down the chart from line to line, always keeping the pin on the left side lined up with line A. Move downward on the chart until the pin on the right side of the drapery fabric lines up with a line just right (or the end) of a pleat. If any minor adjustments need to be made, you may do so by adjusting the straight pins marking your return and overlap.

Step 4. Mark each pleat line with a straight pin on the top edge of the fabric, fold the pleats in half lining up the two marker pins. Now sew the pleats in place.

If a drapery panel is wider then the chart: Follow steps 1 and 2. Fold fabric in half, lining up the two marker pins with each other. Place marker pins on line 1A and move drapery vertically down the chart until the opposite end falls perfectly in the center of an unpleated area. Mark both sides of the fabric on the pleat lines, fold and sew pleats in place.

SUMMARY OF THE INVENTION

The invention provides a chart and a method of using the chart to provide a simple, inexpensive means of showing the precise location of the pleated and unpleated areas of any width drapery.

The chart consists of a series of progressive lines. These lines determine where the pleated and unpleated areas are located and the width of each pleated and unpleated area.

Although the chart has increased by only 1182 " between lines 1A and 27A, the chart has been drawn to the point where it begins to repeat itself.

The chart is printed on a durable material, preferrably a heavy weight paper or light weight cloth, tht may be rolled, and shipped or stored in a tube as small as 2" by 14".

The object of this invention is to provide a chart and a method of using the chart that allows anyone to construct professional looking draperies easily and inexpensively.

DETAILED DESCRIPTION OF THE DRAWINGS

Figure 1:
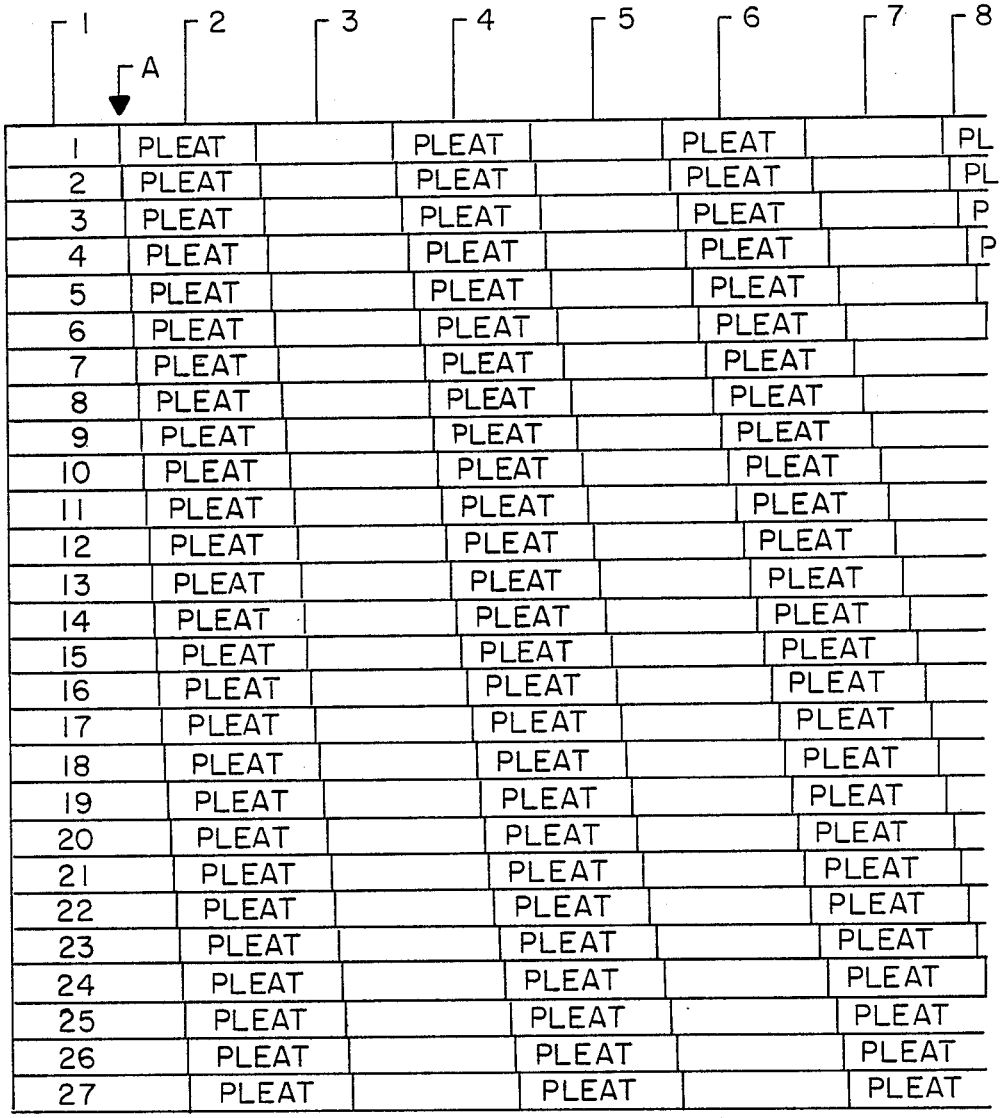
FIG. 1 is a perspective view.

Horizontal odd numbers down the length of the chart are the unpleated areas.

Horizontal even numbers down the length of the chart are the areas to be pleated.

Line 1. Horizontally when drawn to scale, will be measured and marked at 3 1/4" increments. This measurement will continue down the length of the chart, or approximately 13' 6".

Line 2. Mark "A" is placed 1/16" to the right of 1A and will be marked at 3 5/16" increments down the remainder of the chart.

Line 3. Mark "A" is placed 1/16" to the right of 2A and will be marked at 3 3/8" increments down the remainder of the chart.

Line 4. Mark "A" is placed 1/16" to the right of 3A and will be marked at 3 7/16" increments down the remainder of the chart.

Line 5. Mark "A" is placed 1/16" to the right of 4A and will be marked at 3 1/2" increments down the remainder of the chart.

Line 6. Mark "A" is placed 1/16" to the right of 5A and will be marked at 3 9/16" increments down the remainder of the chart.

Line 7. Mark "A" is placed 1/16" to the right of 6A and will be marked at 3 5/8" increments down the remainder of the chart.

Line 8. Mark "A" is placed 1/16" to the right of 7A and will be marked at 3 11/16" increments down the remainder of the chart.

Line 9. Mark "A" is placed 1/16" to the right of 8A and will be marked at 3 3/4" increments down the remainder of the chart.

Line 10. Mark "A" is placed 1/16" to the right of 9A and will be marked at 3 13/16" increments down the remainder of the chart.

Line 11. Mark "A" is placed 1/16" to the right of 10A and will be marked at 3 7/8" increments down the remainder of the chart.

Line 12. Mark "A" is placed 1/16" to the right of 11A and will be marked at 3 15/16" increments down the remainder of the chart.

Line 13. Mark "A" is placed 1/16" to the right of 12A and will be marked at 4" increments down the remainder of the chart.

Line 14. Mark "A" is placed 1/16" to the right of 13A and will be marked at 4 1/16" increments down the remainder of the chart.

Line 15. Mark "A" is placed 1/16" to the right of 14A and will be marked at 4 1/8" increments down the remainder of the chart.

Line 16. Mark "A" is placed 1/16" to the right of 15A and will be marked at 4 3/16" increments down the remainder of the chart.

Line 17. Mark "A" is placed 1/16" to the right of 16A and will be marked at 4 1/4" increments down the remainder of the chart.

Line 18. Mark "A" is placed 1/16" to the right of 17A and will be marked at 4 5/16" increments down the remainder of the chart.

Line 19. Mark "A" is placed 1/16" to the right of 18A and will be marked at 4 3/8" increments down the remainder of the chart.

Line 20. Mark "A" is placed 1/16" to the right of 19A and will be marked at 4 7/16" increments down the remainder of the chart.

Line 21. Mark "A" is placed 1/16" to the right of 20A and will be marked at 4 1/2" increments down the remainder of the chart.

Line 22. Mark "A" is placed 1/16" to the right of 21A and will be marked at 4 9/16" increments down the remainder of the chart.

Line 23. Mark "A" is placed 1/16" to the right of 22A and will be marked at 4 5/8" increments down the remainder of the chart.

Line 24. Mark "A": is placed 1/16" to the right of 23A and will be marked at 4 11/16" increments down the remainder of the chart.

Line 25. Mark "A" is placed 1/16" to the right of 24A and will be marked at 4 3/4" increments down the remainder of the chart.

Line 26. Mark "A" is placed 1/16" to the right of 25A and will be marked at 4 13/16" increments down the remainder of the chart.

Line 27. Mark "A" is placed 1/16" to the right of 26A and will be marked at 4 7/8" increments down the remainder of the chart.

Vertical numbers 1 through 27, when drawn to scale, will be approximately one half inch apart.

Referring now to FIG. 1. Looking down line 1A, vertical numbers one through twenty seven get progressively wider by 1/16" per row. These measurements determine where the pleated and unpleated areas will be placed. They also determine the fullness of the drapery.

The chart is designed to give double fullness to a drape, but could easily be modified to give or take away fullness by adding or subtracting from the width of the pleated area only.

Horizontal numbers, initially start out 1/16" wider, but are then drawn in the same increments down the remainder of the chart. These numbers determine how wide the pleated and unpleated areas will be. They also could be easily modified.

Figure 2:
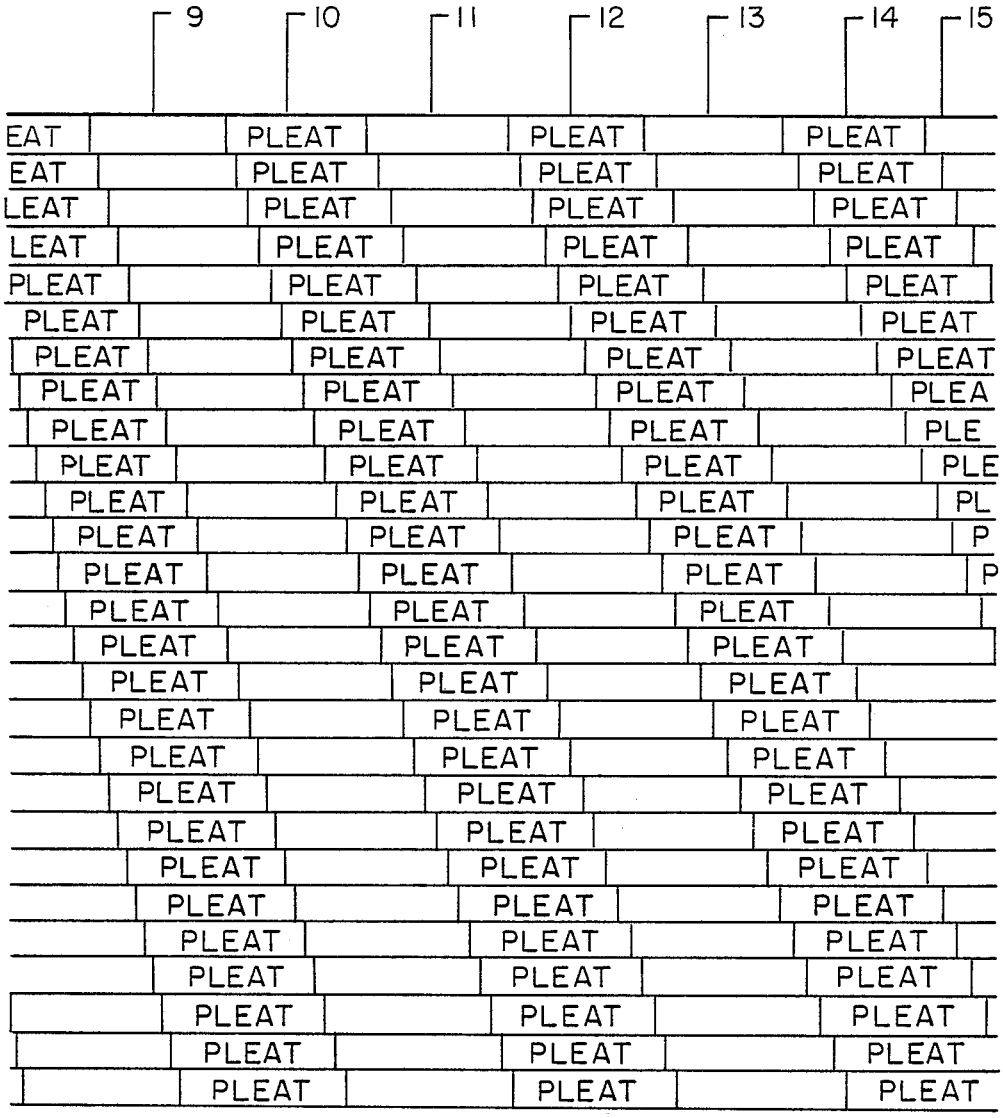
FIG. 2 is a continuation of FIG. 1.

Referring now to FIG. 2, which is a continuation of FIG. 1.

The complete horizontal width of the chart is not drawn because it can be made any width. What is important, is that when the chart is continued, it must be drawn in the same increments as FIGS. 1 and 2 were drawn.

I claim:

1. A method of determining the precise location of pleated and unpleated areas on a given width of drapery material, which comprises laying the material on a work table and measuring a return portion on the left hand side and an overlap portion on the right side; sticking a straight pin in an upright position in the upper edge of the material to mark the portions placing a chart under said material, the chart comprising a pattern of short vertical lines forming a plurality of downwardly sloping columns of horizontal spaces extending from left to right of said chart and having alternate columns of blank spaces and spaces including the word pleat thereon; positioning said material wrong side up on said chart so that the pin stuck in the return portion lines up with the series of slanting vertical lines forming the right side of the first column; moving said material downwardly along the slanting lines while keeping the overlap portion in horizontal alignment until said overlap pin falls on a vertical line on the right side of a column having the word pleat thereon; marking the boundary lines with a pin in said material at each space along said chart showing said pleat; removing said material for sewing the marked pleated areas.

2. A method as claimed in claim 1, wherein the measurement to said return is 3 1/2" and 3" for said overlap portion.

3. A method as claimed in claim 1, wherein for lengths of said material longer than said chart the pleated areas may be marked on said material by folding in half so as to line up said return and overlap pins together and following the procedure of claim 1, move the opposite end downwardly until it falls within the center of said space of one of said blank columns.

4. A chart whereon drapery material is placed for locating the bounds of pleated and unpleated areas by moving the pinned return and overlap portions of said material downwardly on columns of slanting vertical lines until said pins fall on a pair of spaced lines having alternate spaces of pleated and unpleated areas therebetween, comprising an elongated rectangular surface having an arrangement of columns sloping to the right of the chart containing offset vertical lines defining a plurality of horizontal rows of spaces, the columns extending along said chart having alternate areas of pleated and unpleated spaces, the row of spaces in the first column being numbered from the uppermost to the bottom of said spaces, said columns likewise being numbered horizontally from left to right.

5. A chart as claimed in claim 4, wherein said rows of spaces in said first column are bound on the left by an upright string of short vertical lines and on the right by similar lines each being offset progressively by a constant increment of length to the right of an adjacent line in above said row forming a slanting string of said lines, and the width of said space therebetween being equal to the uppermost of said spaces plus the increment times said row number, and said rows of horizontal spaces in said columns are equal in width with said rows of said spaces in the second column, and said short vertical lines in any column except said first row the spaced vertical lines are together progressively offset by said increment with said lines in the preceding column of said rows and the combined offset length being progressively to the right is equal to said offset in said second column times the number of said columns to the right of said second column and as the offset length increases the slant of said column lines become progressively steeper.

6. A chart as claimed in claim 5, wherein a set of said lines in the uppermost row of horizontal spaces is approximately $3\frac{1}{4}''$ apart and the said increment is 1/16″ in length, therefore the width of said spaces in said columns increases from the uppermost to the bottom by the $3\frac{1}{4}''$ plus 1/16 times the number of rows from the top of said column, said bottom row space being $4\frac{7}{8}''$ wide, and said offset length of said vertical line in any of said columns is equal to two times 1/16 times the number of said column to the right of said second column.

7. A chart as claimed in claim 1, wherein said chart is a flexible sheet which can be shaped into a compact package for shipping and storage.

8. A chart as claimed in claim 7, wherein the chart is a durable form of paper.

* * * * *